United States Patent [19]

Rochlus

[11] 4,425,880

[45] Jan. 17, 1984

[54] ROTATING CYLINDER INTERNAL COMBUSTION ENGINE

[76] Inventor: Bertram J. Rochlus, 5730 N. 96th St., Milwaukee, Wis. 53225

[21] Appl. No.: 283,854

[22] Filed: Jul. 16, 1981

[51] Int. Cl.[3] ..... F02B 57/06

[52] U.S. Cl. ..... 123/44 C

[58] Field of Search ..... 123/44 C, 65 VA, 71 R, 123/66, 71 VA, 563 C, 73 VA, 73 B

[56] References Cited

U.S. PATENT DOCUMENTS

| | | | |
|---|---|---|---|
| 1,299,662 | 4/1919 | Beggs | 123/44 C |
| 1,437,928 | 12/1922 | Brockway | 123/44 C |
| 1,720,414 | 7/1929 | Gruebler | 123/73 B X |
| 1,980,924 | 11/1934 | McDonald | 123/44 C |
| 2,092,841 | 9/1937 | Groskritz | 123/44 C X |
| 3,599,612 | 8/1971 | Villella | 123/44 C X |
| 4,178,885 | 12/1979 | Konther et al. | 123/44 C |

*Primary Examiner*—Michael Koczo
*Attorney, Agent, or Firm*—Henry C. Fuller

[57] ABSTRACT

Internal combustion engine having a rotating closed cylinder housing mounted to a fixed frame and means to harness the rotation of the cylinder housing to rotate an output shaft. The cylinder housing contains a double ended piston to define two combustion chambers between the corresponding ends of the piston and the cylinder housing. Alternating combustion of fuel in the combustion chambers reciprocates the piston within the cylinder housing. A Scotch yoke mechanism linking the cylinder, piston, and frame harnesses the reciprocating motion of the piston within the cylinder housing to rotate the cylinder housing. In a preferred embodiment of the invention a second cylinder housing counterrotates about a common axis to cancel the spin angular momentum of the first housing and to double the power provided by the engine. The engine employs a two stroke combustion cycle in a preferred embodiment of the invention. Suitable valve and conduit means regulate the entry of air and fuel and the venting of exhaust gases to allow combustion to take place within the combustion chambers.

23 Claims, 9 Drawing Figures

ROTATING CYLINDER INTERNAL COMBUSTION ENGINE

TECHNICAL FIELD

The invention relates to internal combustion engines of the type having a rotating cylinder housing and a reciprocating piston captured within the cylinder.

BACKGROUND ART

Typical internal combustion engines have many reciprocating parts for each combustion chamber, such as pistons, piston rods, and valve assemblies. Because these reciprocating parts are constantly accelerated and decelerated while the engine is at work, they rob output power from the engine and cause vibrations which can damage the engine or create a nuisance.

Prior engines also have many parts which rotate while the engine is in motion. Such parts include a crankshaft and flywheel, fan, camshaft, and other related parts of the engine. These engine parts have substantial spin angular momenta and thus are like gyroscopes, preventing the engine mounting from being moved freely. If the engine is mounted to a vehicle, this gyroscopic effect can inhibit steering.

SUMMARY OF THE INVENTION

The present invention is an internal combustion engine containing few or no reciprocating parts, and preferably having moving parts which rotate in opposite directions in order to cancel their spin angular momenta.

The engine comprises a stationary frame member which carries a closed cylinder housing mounted for rotation about a lateral axis. A double ended piston captured within the cylinder has first and second working faces on opposite ends, each of whcih is opposed to one end of the cylinder to define first and second combustion chambers. Means are provided to introduce a charge of a combustible fuel mixture alternately in each combustion chamber, to move the piston to compress the charge, to ignite the charge, and to discharge the expanded exhaust gases from the combustion chamber. The combustion of the fuel alternately in the combustion chambers reciprocates the piston rectilinearly with respect to the cylinder housing.

First power transmission means coupled to the piston, preferably comprising a Scotch yoke linkage employing a stationary crank engaging a crosshead slot in the piston, harness the rectilinear motion of the piston to rotate the housing. Second power transmission means coupled to the housing harness the rotation of the housing to drive an output shaft.

In a preferred embodiment of the invention two cylinder housings as just described are rotated in opposite directions on a common lateral axis so the spin angular momenta of the housings cancel.

Although the piston reciprocates rectilinearly with respect to the rotating cylinder housing, it describes a nearly circular path with respect to the frame member. Thus, the piston and associated parts are not accelerated or decelerated as much as the reciprocating parts of an engine having stationary cylinders. In addition, the reciprocating piston rods and valve assemblies of a conventional engine are eliminated in a preferred embodiment of the invention.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

Figure 1:
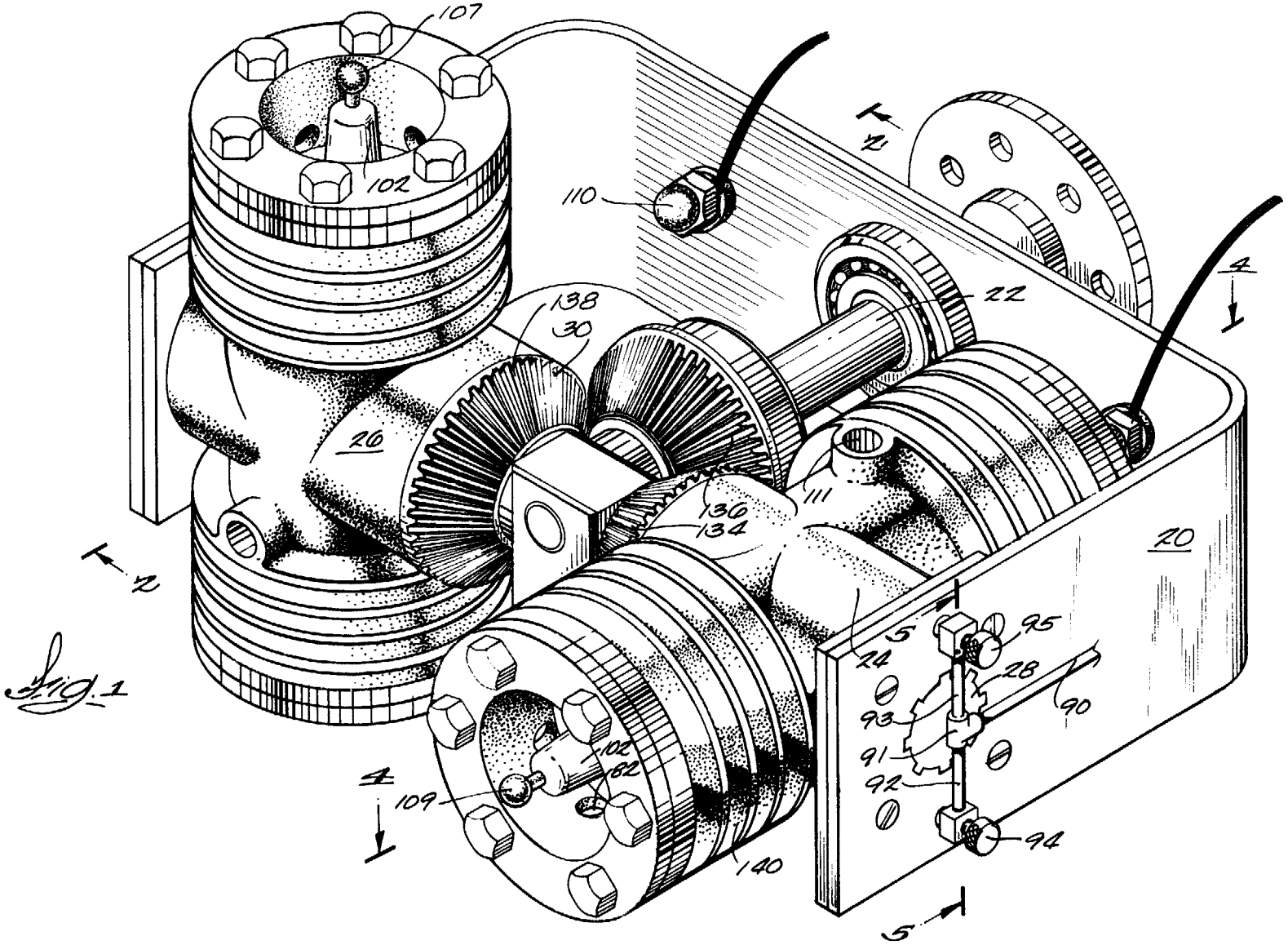
FIG. 1 is a perspective view of one embodiment of the invention.

Referring first to FIG. 1, the portions of the engine visible from the outside are frame member 20, output shaft 22, cylinder housings 24 and 26 counter-rotating about a common lateral axis, and a stationary crankshaft 28 keyed to frame member 20 to support the cylinder housings and forming a part of first transmission means to assist in harnessing the reciprocating motion of the piston to rotate the cylinder housings. FIG. 1 also shows second transmission means generally indicated as 30 to transmit the torques of the counter-rotating cylinders to output shaft 22. The cylinder housings are identical and are identically connected to frame 20, output shaft 22 and crankshaft 28, so only one cylinder housing and its contents and connections will be discussed in detail. The invention, however, is not limited to embodiments in which both cylinder housings and their related parts are identical.

Figure 2:
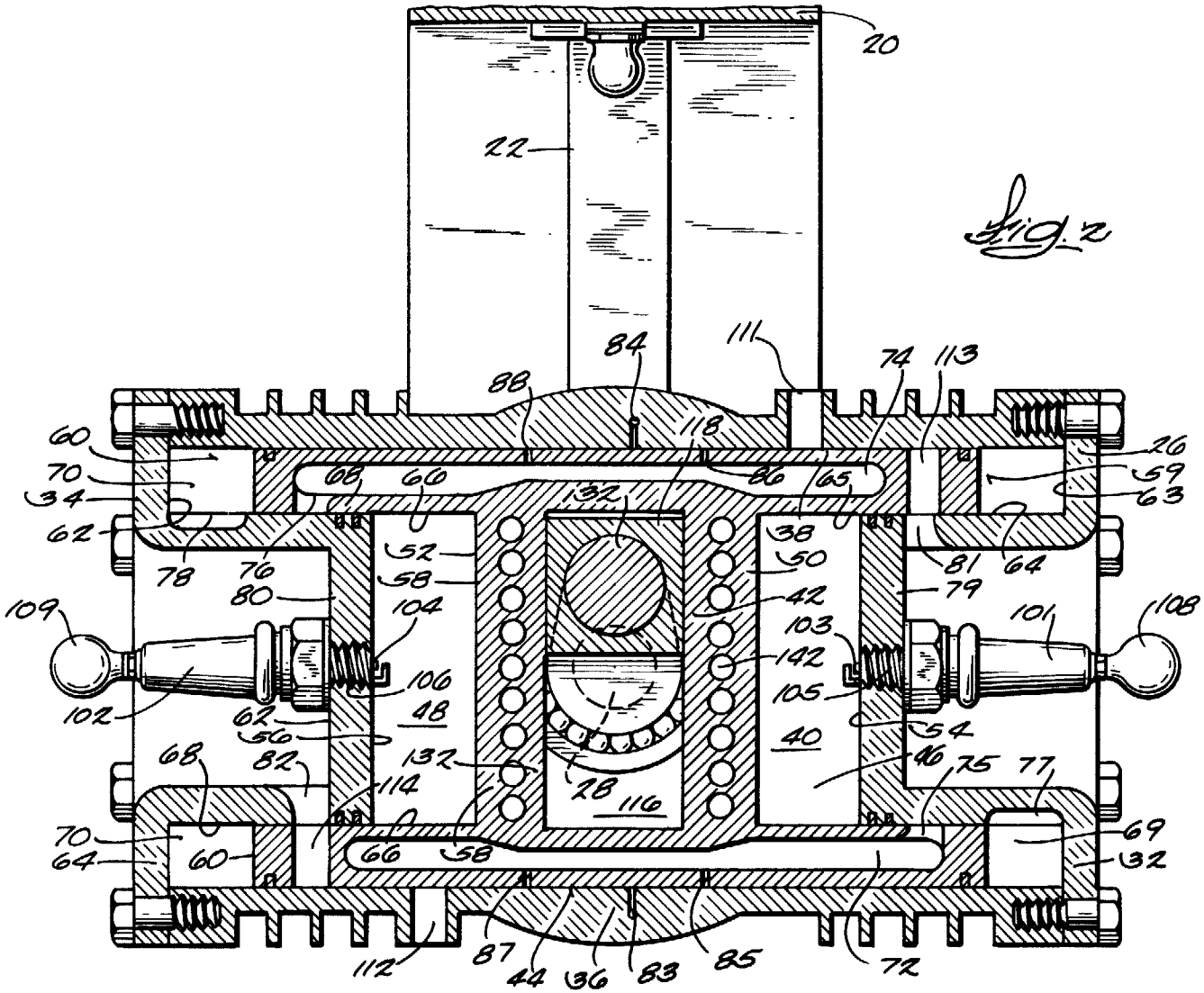
FIG. 2 is an axial cross section of one cylinder and piston assembly, taken along line 2—2 in FIG. 1.
Figure 3:
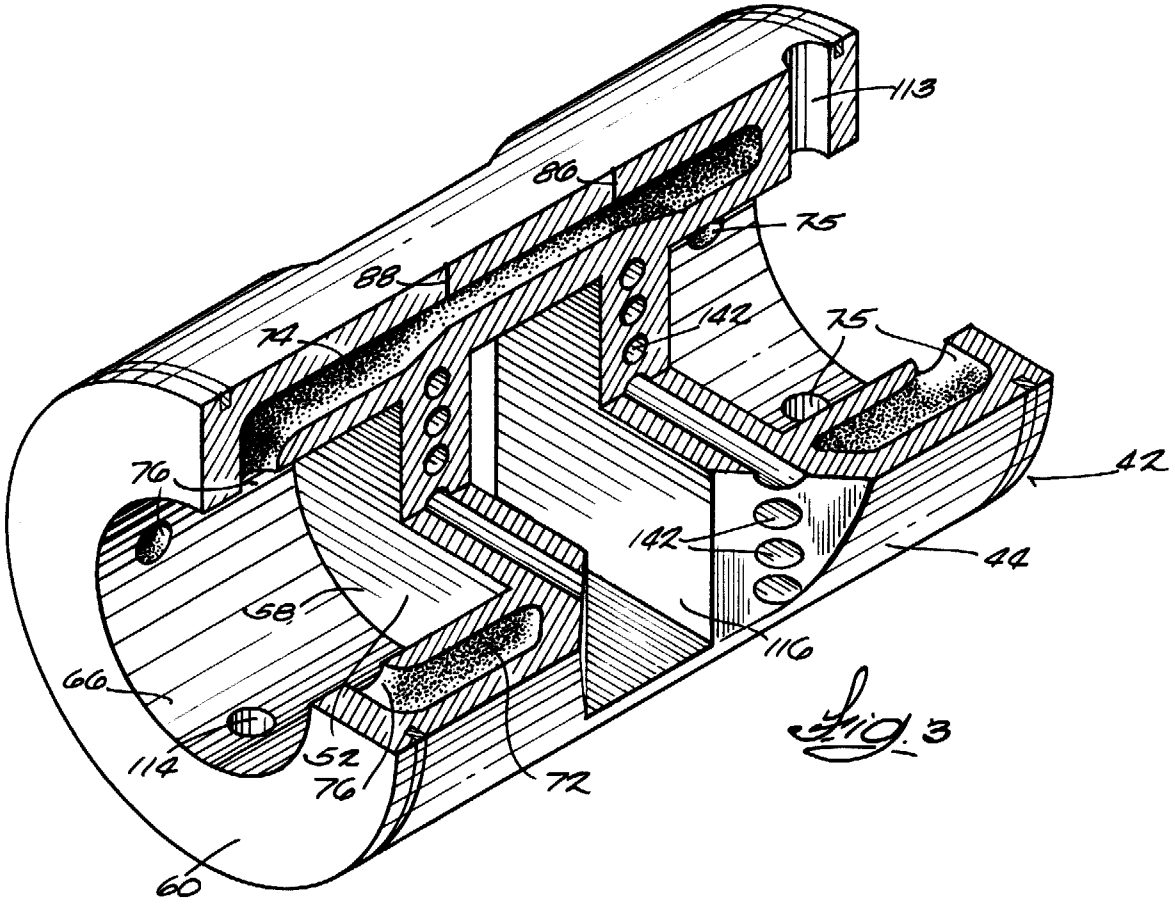
FIG. 3 is a perspective view of an isolated piston, cut away to show its interior structure.

The internal structure of the engine is shown in FIGS. 2, 3, 4, and 5. Referring to FIG. 2, cylinder housing 26 comprises first and second cylinder heads 32 and 34 bolted to a tubelike central element 36 having a cylindrical inner wall 38 which extends from one cylinder head to the other to enclose an interior space 40. A double ended piston 42 resembling the letter "H" in cross section is captured within space 40 and has a generally cylindrical outer wall 44 which sealingly engages wall 38 to divide space 40 into first and second identical combustion chambers 46 and 48. Piston 42 has first and second working faces 50 and 52 respectively opposed to first and second cylinder ends 54 and 56 to define the axial limits of the combustion chambers. Piston 42 is slidable within interior space 40 to increase or decrease the volumes of combustion chambers 46 and 48. When one combustion chamber is growing in volume the other is shrinking.

Looking now in more detail at combustion chambers 46 and 48, they are each generally cylindrical. Working faces 50 and 52 of piston 42 have recessed central portions 57 and 58 and annular peripheral portions 59 and 60. Cylinder ends 54 and 56 are similarly divided into extended or raised portions 61 and 62, received in recessed central portions 57 and 58, and annular peripheral portions 63 and 64 opposing annular portions 59 and 60. Recessed portions 57 and 58 of the piston have cylindrical inner walls 65 and 66 which slidingly and sealingly receive outer walls 67 and 68. Combustion chambers 46 and 48 are thus confined substantially within recessed portions 57 and 58.

Outer walls 67 and 68, inner wall 38, and annular peripheral portions 59, 60, 63, and 64 define annular spaces 69 and 70 having volumes which vary depending on the position of piston 42 in the cylinder housing. Annular spaces 69 and 70 do not communicate directly with combustion chambers 46 and 48 for any position of piston 42 within space 40. Annular spaces 69 and 70 contribute to the induction of atmospheric air into combustion chambers 46 and 48.

Within the legs of H-shaped piston 42 are two toroidal cavities joined by transfer spaces 72 and 74 which accumulate and transfer air into the respective combustion chambers from the respective annular spaces. Transfer space 72 communicates through port 75 with combustion chamber 46 when the combustion chamber is at its greatest volume due to maximum retraction of piston 42 from cylinder end 54. When combustion chamber 46 is fully contracted, port 75 communicates between transfer space 72 and annular space 69 via bypass 77. When piston face 50 is between its extremes of travel, port 75 is closed off and transfer space 72 is sealed. Transfer space 74, port 76, and bypass 78 perform a similar function with respect to combustion chamber 48 and annular space 70. Annular spaces 69 and 70 periodically communicate with ambient air in the recessed outside walls 79 and 80 of the cylinder heads via ports 81 and 82 when piston 42 is fully withdrawn from the corresponding cylinder end 54 or 56.

The cylinder housings and pistons contain cooperating elements which allow fuel to be indirectly injected into combustion chambers 46 and 48. The fluid lines to convey a combustible fluid such as gasoline to the combustible chambers include injection ports 83 and 84 in housing 26 to inject a combustible fluid such as gasoline into the corresponding air supply means. Injection ports 83 and 84 are normally blocked by outer cylindrical wall 44. But when port 85 or port 87 lines up with injection port 83, a jet of fuel is momentarily squirted into transfer space 72 where it mixes with the air therein. Ports 85 and 87 are so positioned that fuel is squirted into the transfer space 72 twice for each charge of a combustible mixture of air and fuel formed therein. Ports 86 and 88 similarly cooperate with injection port 84 to charge transfer space 74 with fuel. The preferred embodiment of the engine is thus fuel injected, eliminating the need for an independent carburetor to form the charge of combustible vapor to be burned.

Figure 5:
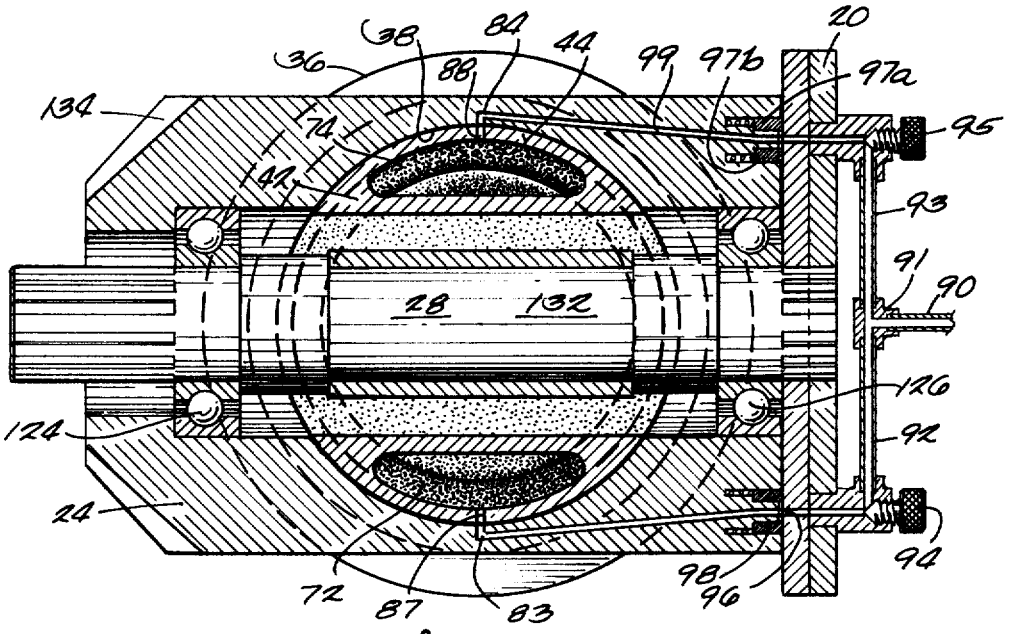
FIG. 5 is a fragmentary cross-section of the invention, taken along line 5—5 in FIG. 1.

FIGS. 1 and 5 show one embodiment of means for charging fuel from a stationary source to injection ports 83 and 84 of the moving cylinder housing 24. The stationary parts of the system are a line 90 communicating with a fuel tank (not shown); a tee 91 connecting line 90 to branch lines 92 and 93; and needle valves 94 and 95 to regulate the flow of fuel to an interface 96 between the moving and stationary parts of the system. The moving parts of the fuel system are concentric floating seals 97*a* and 97*b* (defining the inner and outer limits of interface 96) and passages 98 and 99, each communicating between the corresponding injector and one of branch lines 92 and 93 when a branch line and passage momentarily line up. Comparing FIGS. 2 and 5, when passage 99 lines up with branch line 93 injector 84 lines up with port 88. Similarly, when passage 98 lines up with branch line 92 injector 83 lines up with port 87. When the cylinder housing inverts during its rotation, port 85, injector 83, passage 98, and branch line 93 momentarily line up, as do port 86, injector 84, passage 99 and branch line 92. A charge of fuel thus flows from stationary line 90 to each transfer space 72, 74 twice during each revolution of housing 24 or 26, at times when all the intervening passages line up.

Figure 4:
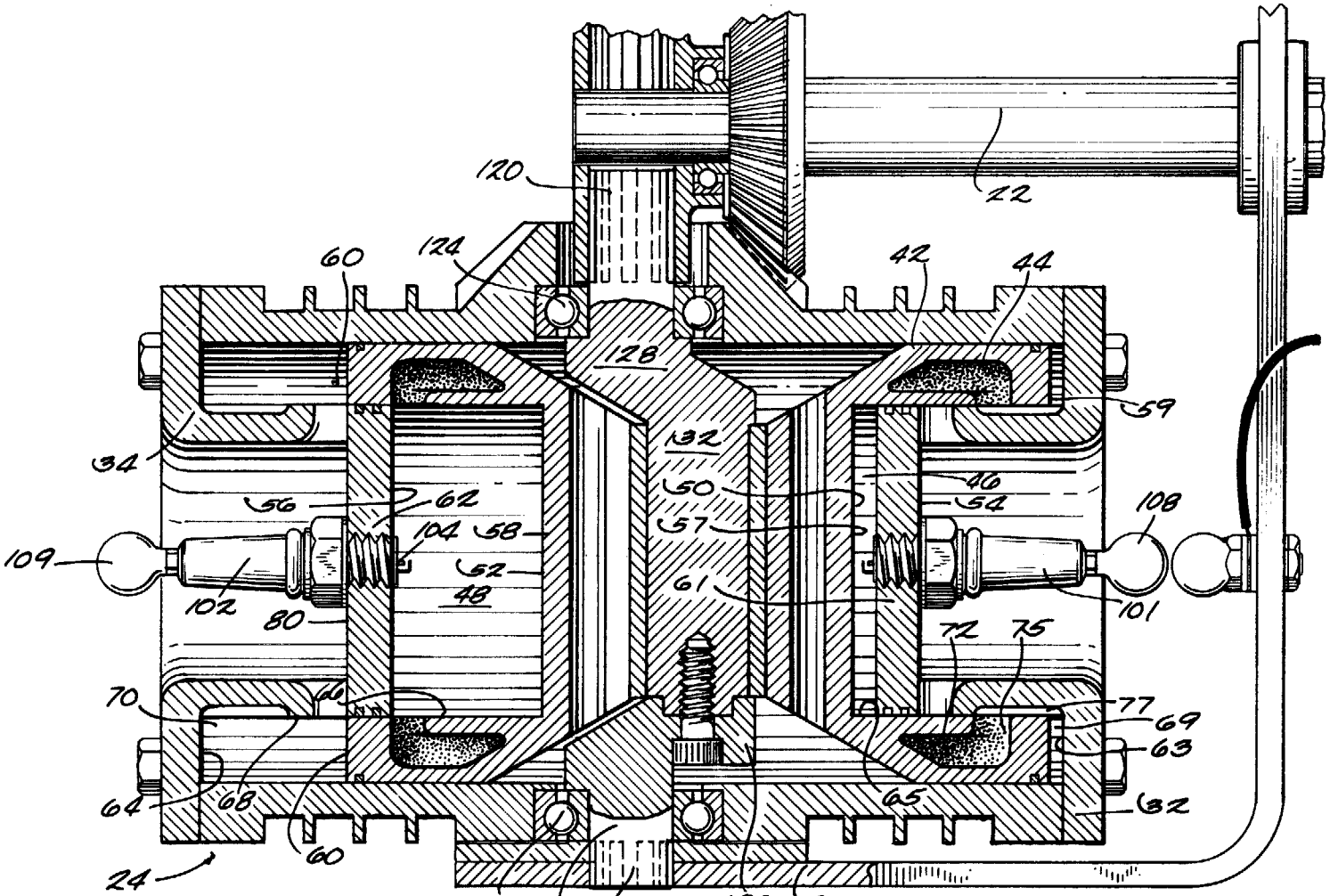
FIG. 4 is a fragmentary cross section of the invention, taken along line 4—4 in FIG. 1.

Unless the internal combustion engine herein is a diesel engine, in which case an electrical ignition system might be avoided, means must be provided to electrically ignite charges of the combustible mixture within combustion chambers 46 and 48. The preferred ignition means, shown in FIGS. 1, 2 and 4, are conventional spark plugs such as 101 and 102 mounted axially through cylinder heads 32 and 34 and comprising centrally disposed contacts 103, 104 electrically insulated from bases 105 and 106. Bases 105 and 106 are connected through the usual negative ground to the negative pole of an external source of electrical power, typically a battery or alternator. As best shown in FIG. 1 in connection with cylinder housing 26, an exposed moving contact 107 at the end of the spark plug (identical to contacts 108 and 109 of spark plugs 101 and 102) periodically touches a contact point 110 as the housing 26 rotates. Contact point 110 is insulated from frame 20, and is connected via a typical ignition circuit to the positive terminal of an external battery or alternator to supply an ignition pulse. When contact 110 is electrically engaged by contact 107, the ignition circuit is completed. As best shown in FIG. 4, the circuit is completed when the combustion chamber (here, 48) has contracted to its minimum volume and contains a compressed charge of fuel to be ignited. By using the whirling cylinder housing to make and break electrical contact with a fixed point, the need for a separate distributor is avoided. The engine can be variously timed by providing means to move contact point 110 up or down on frame 20. As shown, one contact such as 110 can suffice to ignite the fuel in each combustion chamber of one cylinder housing.

Returning to FIG. 2, the exhaust system for the compression chambers will now be described. Central element 36 of housing 26 includes exhaust ports 111 and 112 periodically connected with chambers 46 and 48 by ports 113 and 114. Thus, combustion chamber 46 is vented to the atmosphere when piston 42 is fully withdrawn from cylinder end 54, and combustion chamber 48 is likewise vented when piston 42 is fully withdrawn from cylinder end 56.

Enough of the combustion cycle means of the engine have now been explained to allow a complete description with respect to FIGS. 6, 7, 8, and 9 of the combustion cycle of the engine. Referring generally to FIGS. 6 through 9, eight positions of the combustion cycle are shown. Since combustion chambers 46 and 48 are 180° out of phase, for economy of illustration the first four positions of the cycle are shown in combustion chamber 48, while the last four positions of the combustion cycle are shown with reference to combustion chamber 46. It will be understood, however, that these eight steps occur sequentially in each combustion chamber.

The combustion cycle shown in FIGS. 6 through 9 is a two stroke cycle. The exhaust gases are first exchanged for a fresh charge of the combustible vapor, then the momentum of the engine provides a compression stroke to compress the new charge of gases before it is ignited to initiate the following power stroke. It will be understood, however, that by providing suitable valving a four stroke engine could be constructed employing the principles of this invention.

Figure 6:
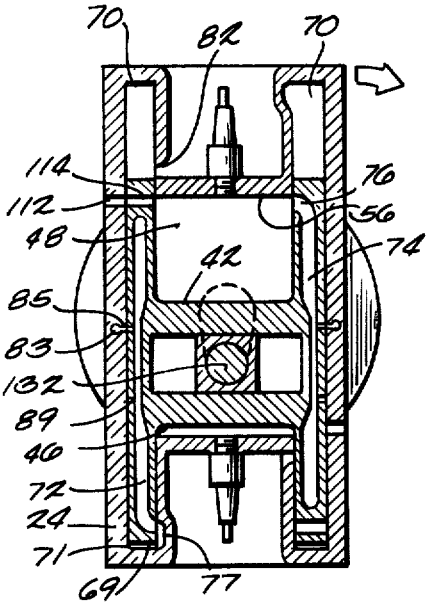
FIGS. 6, 7, 8, and 9 are views similar to FIG. 2 showing the operation of the present invention during a combustion cycle.

Referring first to combustion chamber 48 in FIG. 6, this chamber is fully expanded because piston 42 is fully withdrawn from cylinder end 56. At this point ports 112 and 114 are lined up and port 76 communicates with combustion chamber 48. Annular space 70 is so sized with respect to transfer space 74 that the combustible mixture contained within transfer space 74 is at greater pressure than the expanded gases within combustion chamber 48. Thus, flow of a combustible mixture through port 76 into the combustion chamber drives the exhaust gases out of the cylinder housing through ports 112 and 114.

Figure 7:
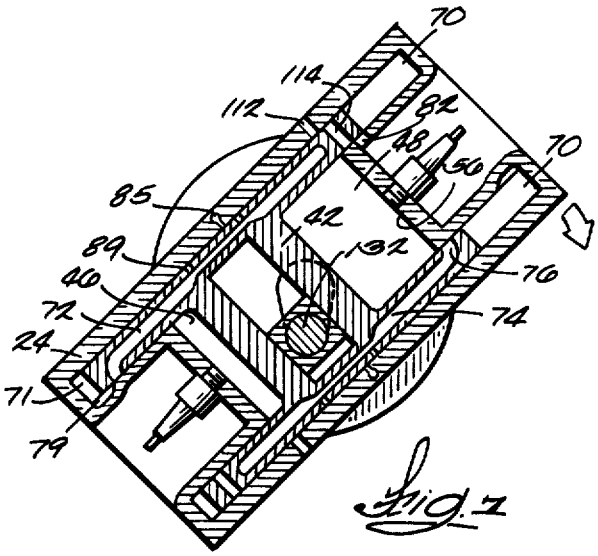

The second step of the cycle is shown in FIG. 7, wherein housing 24 has rotated 45° clockwise due to the rotational momentum of the engine, assisted by the simultaneous beginning of a power stroke in combustion chamber 46. Piston 42 is beginning to advance toward cylinder end 56, thus compressing the combustible mixture within compression chamber 48. At this point, port 76 no longer communicates with the combustion chamber, ports 112 and 114 are no longer aligned, and port 82 no longer communicates between annular space 70 and the ambient air. Thus, at this stage transfer space 74, annular space 70 and combustion chamber 48 are each sealed, space 74 remains constant in volume, and the volumes of annular space 70 and combustion chamber 48 are being reduced by the advance of piston 42 toward cylinder end 56.

Figure 8:
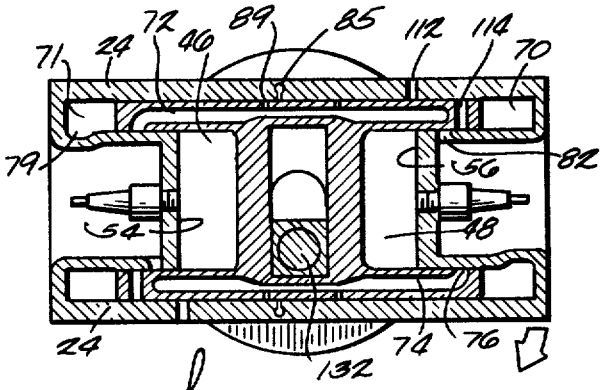

Referring now to FIG. 8 showing further rotation of cylinder housing 24, combustion chamber 48, annular space 70, and transfer space 74 remain isolated from each other and the volumes of combustion chamber 48 and annular space 70 are steadily decreasing, further compressing the air in annular space 70 and the combustible mixture in combustion chamber 48.

Figure 9:
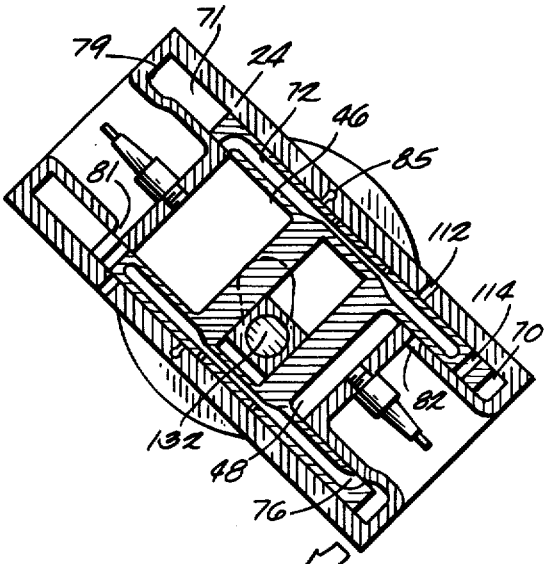

In FIG. 9 housing 24 has advanced 45° more. Ports 76, 112 and 114, and 82 all remain closed as in the previous two portions of the cycle and combustion chamber 48 and annular space 70 are compressed almost to their minimum volumes, thus compressing the respective charges of fuel and air.

Returning now to FIG. 6, the next stage in the combustion cycle is shown by combustion chamber 46 in which the combustible vapor is fully compressed and the ignition circuit has ignited the portion of the fuel mixture adjacent the spark plug. At this point, transfer space 72 communicates via bypass 77 with annular space 69, allowing air to enter the transfer space. At the same time injection port 83 communicates via port 85 with transfer space 72, thus injecting fuel into the transfer space for preheating and admixture with the air entering transfer space 72.

The sixth stage of the combustion cycle is shown in FIG. 7 wherein the entire charge in combustion chamber 46 has exploded, driving piston 42 away from cylinder end 54. At this stage the retraction of piston 42 from cylinder end 54 has again cut off the previous communication between annular space 69 and transfer space 72 via bypass 77 so that annular space 69, combustion chamber 46, transfer space 72, and the ambient air outside the cylinder are all again isolated from each other.

The seventh stage of the combustion cycle is shown by combustion chamber 46 in FIG. 8. At this point piston 42 is approximately centered between cylinder ends 54 and 56 so the ignited charge in combustion chamber 46 is expanded to about half its maximum volume. As in the preceeding stage, all the recited spaces are isolated from each other.

Combustion chamber 46 in FIG. 9 is directly between the stage of combustion chamber 46 in FIG. 8 and the stage of combustion chamber 48 in FIG. 6. Chamber 46 in FIG. 9 is shown just before the intake and exhaust ports are simultaneously opened and annular space 71 is exposed to outside air through port 81.

Since each of the eight advances in the combustion cycle just described was accomplished by a 45° rotation of the cylinder housing, the complete combustion cycle requires one complete revolution of the cylinder housing.

Now that the combustion cycle for reciprocating piston 42 within cylinder housing 24 has been explained, the first power transmission means for harnessing the reciprocation of piston 42 to rotate cylinder housing 24 becomes important in understanding how the engine runs.

FIGS. 2 and 4 in particular show the Scotch yoke linkage which converts reciprocation of the piston to rotation of the cylinder housing. The first transmission means comprises a stationary crankshaft 28, a crosshead slot 116 formed in the cross bar of "H" shaped piston 42, and a sliding block 118 captured in cross head slot 116 for rectilinear sliding motion along a line mutually perpendicular to the axis of the cylinder housing and the lateral axis about which the cylinder housing rotates.

Crankshaft 28 is a rigid member having first and second ends 120 and 122 fixed to frame 20 and preferably centered on the lateral axis of rotation, although not critically so because the crankshaft does not rotate. Crankshaft 28 further comprises bearings 124 and 126 adjacent to its respective ends to receive housing 24 for rotation about its lateral axis. First and second crank arms 128 and 130 extend perpendicularly to the lateral axis of rotation and receive a crank pin 132 aligned on an eccentric axis parallel to the lateral axis of rotation. Block 118 is mounted to crank pin 132 and bearings are provided between them to allow block 118 to rotate about said eccentric axis.

Referring now to FIGS. 6 through 9, in FIG. 6 block 118 is centered in crosshead slot 116, thus defining the dead center position of the Scotch yoke in which withdrawal of piston 42 from cylinder end 54 by the expansion of the ignited gases in compression chamber 46 will have no tendency to rotate cylinder housing 24. As in a conventional internal combustion engine, the residual angular mementum of the cylinder housing rotates the Scotch yoke mechanism off dead center to the position shown in FIG. 6 in which block 118 is offset toward one side of crosshead slot 116. This creates a dynamic imbalance so that during the power stroke piston 42 bears against block 118 on crank pin 132 to force cylinder housing 24 to rotate clockwise (as shown in FIGS. 7, 8, and 9) until the cylinder housing is inverted (as again shown in FIG. 6) at its opposite dead center position. Thus, as shown in FIG. 1, in a complete rotation of the cylinder housing, the Scotch yoke crank mechanism is at dead center each time the axis of the cylinder is parallel to output shaft 22.

By placing the crank mechanism within piston 42, a substantial saving in weight of moving parts is realized, for the crank shaft is not a moving part, no piston rods are needed, and one piston does the work of two.

Second transmission means 30 harnesses the rotation of the cylinder housings to transmit torque to output shaft 22. It comprises first gear means 134 fixed to housing 24 for concentric rotation, second gear means 136 mounted to output shaft 22 for concentric rotation, and means interengaging first and second gear means 134 and 136, here by directly meshing the two gear means, to transmit the rotation of first gear means 134 to second gear means 136, rotating output shaft 22. In FIG. 1, counterrotating cylinder housings drive output shaft 22. Third gear means 138 attached to housing 26 counterrotates with respect to gear means 134 so that first and third gear means 134 and 138 each rotate second gear means 136 counterclockwise. In this embodiment of the invention the gear means are each bevel gears.

One particular advantage of the whirling cylinder housing design shown herein is that the rotating housings create considerable turbulence which assists in removing exhaust gases and cooling the engine. Referring to FIG. 1, cooling can be further enhanced by providing cooling fins 140 on the exterior surfaces of the cylinder housings, and by providing holes 142 in piston 42 to limit the conduction of heat from the combustion chambers to the vicinity of the Scotch yoke mechanism.

I claim:

1. An improved internal combustion engine to rotate an output shaft, comprising:

A. a stationary frame member;

B. a cylinder housing mounted to said frame member for rotation about a rotary axis and having first and second ends and a cylindrical inner wall defining an interior space; and wall means defining recessed cylinder heads surrounded by annular spaces;

C. a double-ended piston having a continuous outer wall, H-shaped in cross-section, being captured in said space for rectilinear motion and having first and second recessed working faces respectively opposed to said first and second ends to define first and second combustion chambers in said space; the projecting legs of said H-shaped piston being reciprocatable into said annular spaces surrounding said cylinder heads;

D. transfer means to introduce, a combustible fuel mixture alternately in said first and second combustion chambers, whereby to reciprocate said piston rectilinearly in said space, said fuel transfer means including fuel injection means in the form of fuel inlets in said cylinder housing, wall means defining an annular and generally cylindrical fuel transfer passage located inside of said piston outer wall, fuel injection inlets in said housing wall for communication with said annular transfer passage at a selected timed sequence; an air inlet port in said cylinder wall opposite said annular spaces surrounding said cylinder heads, said piston legs controlling said air inlet ports and affording communication of outside air with said transfer passage for mixing with said fuel;

E. first power transmission means coupled to said piston to transmit the rectilinear motion of said piston to said housing to rotate said housing, said means including a piston slot transverse to the longitudinal axis of said piston, a stationary unitary crankshaft having an axis coincident with said housing rotating axis, an offset crank on said crankshaft, a rectangular block having an aperture for receiving said crank, said block being reciprocatable in said slot to afford piston movement relative to said housing during housing movement; and F. second power transmission means coupled to said housing to transmit the rotation of said housing to said output shaft to rotate said shaft.

2. The engine of claim 1, wherein a portion of each piston working face is recessed to extend said combustion chamber into said piston.

3. The engine of claim 2, wherein an inwardly raised portion of each said cylinder housing end is slidably received within a cylindrical inner surface of said recessed portion to define a combustion chamber substantially within said piston.

4. The engine of claim 3, wherein said raised and recessed portions are central portions of said housing end and piston working face.

5. The engine of claim 4, wherein said raised and recessed portions are surrounded by annular peripheral portions of said cylinder end and said working face.

6. The engine of claim 1, wherein said annular transfer means to transfer said air and said fuel to said combustion chamber to be compressed and ignited includes a constricted passage zone adjacent said inlets to enhance fuel-air mixing within said passage.

7. The engine of claim 6, wherein each said means to transfer air comprises wall means defining a transfer space alternately communicating with a source of air and with said combustion chamber to move air from said source to said chamber.

8. The engine of claim 7, wherein said source of air includes wall means defining a space of varying area between an axially recessed portion of said cylinder end and an axially extended portion of said piston working face slidably received in said recessed portion.

9. The engine of claim 8, wherein said wall means defining a space of varying area includes a port which communicates with an external source of air when said piston is withdrawn from said cylinder end wall, whereby to replenish the air enclosed in said space of varying area.

10. The engine of claim 9, wherein said axially recessed and extended portions of said cylinder end wall and piston working face are annular peripheral portions.

11. The engine of claim 1 including ignition means to ignite a charge of combustible vapor in said combustion chambers.

12. The engine of claim 11, wherein said ignition means comprises spark means to generate a spark within said combustion chamber when the charge in said combustion chamber is compressed.

13. The engine of claim 13, wherein said spark means comprises a spark plug extending through a wall of said cylinder housing into said combustion chamber and an ignition circuit communicating between said spark plug and an external source of electrical power.

14. The engine of claim 13, wherein said circuit comprises a moving contact connected to said spark plug, a stationary contact connected to said external source of power, and means responsive to rotation of said cylinder housing to periodically make and break an electrical connection between said moving and fixed contacts.

15. The engine of claim 1 wherein said combustion cycle means includes exhaust means to exhaust the products of combustion from each said combustion chamber.

16. The engine of claim 15, including a port in said cylinder housing wherein each said combustion chamber extends into a recess in said piston working face, and wherein said exhaust means comprises an exhaust port in said piston side wall communicating between said recess and said port through said cylinder housing when said working face is fully withdrawn from the corresponding cylinder end wall.

17. The engine of claim 1, wherein said first power transmission means comprises Scotch yoke means engaging said frame, cylinder housing and piston.

18. The engine of claim 17, wherein said Scotch yoke means comprises a crosshead slot formed in said piston, a block captured in said slot for sliding back and forth along a line mutually perpendicular to the axis of said cylinder and said lateral axis, and crankshaft means connecting said block to said frame for rotation about an eccentric axis parallel to said lateral axis.

19. The engine of claim 18, wherein said crankshaft means is rigid and has a longitudinal axis, first and second end portions fixed to said frame, first and second bearings adjacent said end portions to mount said cylinder housing for rotation about said lateral axis, and a crank pin centered on said eccentric axis and received in said block, whereby to limit the motion of said block with respect to said frame to rotation about said eccentric axis.

20. The engine of claim 1, wherein said second power transmission means comprises first gear means fixed to said cylinder housing for rotation about said lateral axis, second gear means fixed to said output shaft for rotation about its longitudinal axis, and engagement means for transmitting the torque of said first gear to said second gear.

21. The engine of claim 20, wherein said longitudinal axis and lateral axis are obliquely oriented and said first and second gear means are meshing bevel gears.

22. The engine of claim 1 further comprising a second cylinder housing mounted to said frame for rotation about said lateral axis, and second said piston means, combustion cycle means, and first and second power transmission means associated with said second cylinder housing.

23. The engine of claim 22, wherein said second power transmission means comprises first and second bevel gears mounted to facing portions of said first and second housings for rotation in opposite directions about said lateral axis and a third bevel gear mounted to said output shaft and meshed with said first and second bevel gears, whereby to transfer the respective torques of said first and second cylinder housings to said output shaft, and wherein said first and second cylinder housings rotate in opposite directions whereby to cancel their spin angular moments to permit unconstrained movement of said frame.

* * * * *